US006869086B2

(12) United States Patent
Sadow

(10) Patent No.: US 6,869,086 B2
(45) Date of Patent: Mar. 22, 2005

(54) HANDLE ASSEMBLY FOR WHEELED LUGGAGE

(75) Inventor: Bernard D. Sadow, Chappaqua, NY (US)

(73) Assignee: Outrigger, Inc., Chappaqua, NY (US)

( * ) Notice: Subject to any disclaimer, the term of this patent is extended or adjusted under 35 U.S.C. 154(b) by 0 days.

(21) Appl. No.: 10/251,584

(22) Filed: Sep. 19, 2002

(65) Prior Publication Data

US 2003/0084543 A1 May 8, 2003

Related U.S. Application Data

(63) Continuation-in-part of application No. PCT/US01/47847, filed on Nov. 2, 2001.

(51) Int. Cl.[7] ..... B62K 15/00
(52) U.S. Cl. ..... 280/37; 280/47.26; 190/18 A
(58) Field of Search ..... 280/37, 47.17, 280/47.19, 47.26, 47.371, 47.315, 30, 43.1, 38, 655, 655.1, 47.31, 47.34, 47.36; 190/18 A, 15, 115; 16/110.1, 113.1, 114.1, 409

(56) References Cited

U.S. PATENT DOCUMENTS 5,330,037 A * 7/1994 Wang ..... 280/37
5,394,965 A * 3/1995 Kho ..... 280/37
5,615,757 A * 4/1997 Chen ..... 190/115
5,689,854 A * 11/1997 Wang ..... 16/113.1
5,690,196 A * 11/1997 Wang ..... 190/115
5,706,921 A * 1/1998 Wang ..... 190/115
5,713,441 A * 2/1998 Chen ..... 190/115
5,769,194 A * 6/1998 Chang ..... 190/18 A
5,884,362 A * 3/1999 Tsai ..... 16/113.1
6,079,527 A * 6/2000 Kuo ..... 190/115
6,237,734 B1 * 5/2001 Chen ..... 190/18 A
6,409,207 B1 * 6/2002 Kuo ..... 280/655.1
6,533,086 B1 * 3/2003 Waddell et al. ..... 190/18 A

* cited by examiner

*Primary Examiner*—Christopher P. Ellis
*Assistant Examiner*—Hau Phan
(74) *Attorney, Agent, or Firm*—Abelman, Frayne & Schwab

(57) ABSTRACT

A wheeled luggage case is provided with a universal pivoting extendable handle assembly that includes a handle that is movable from a protected retracted position in a contoured mounting plate to a fixed angularly rotated position that is about 35° from the vertical in order to minimize the vertical force on the handgrip experienced by users of wide range of heights while towing the luggage. The handle can be provided with one or a pair of telescoping legs and various handgrip configurations.

21 Claims, 6 Drawing Sheets

FIG. 3
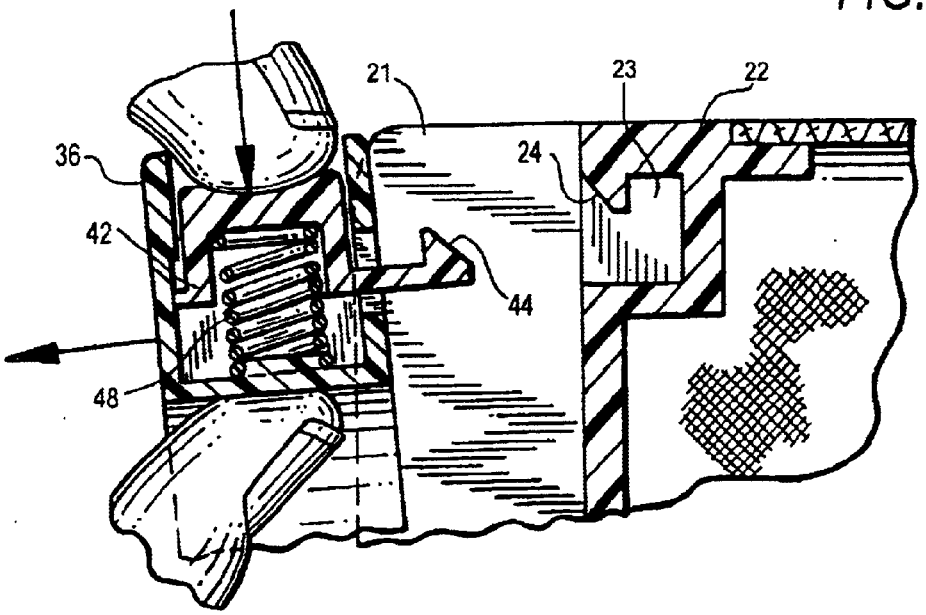
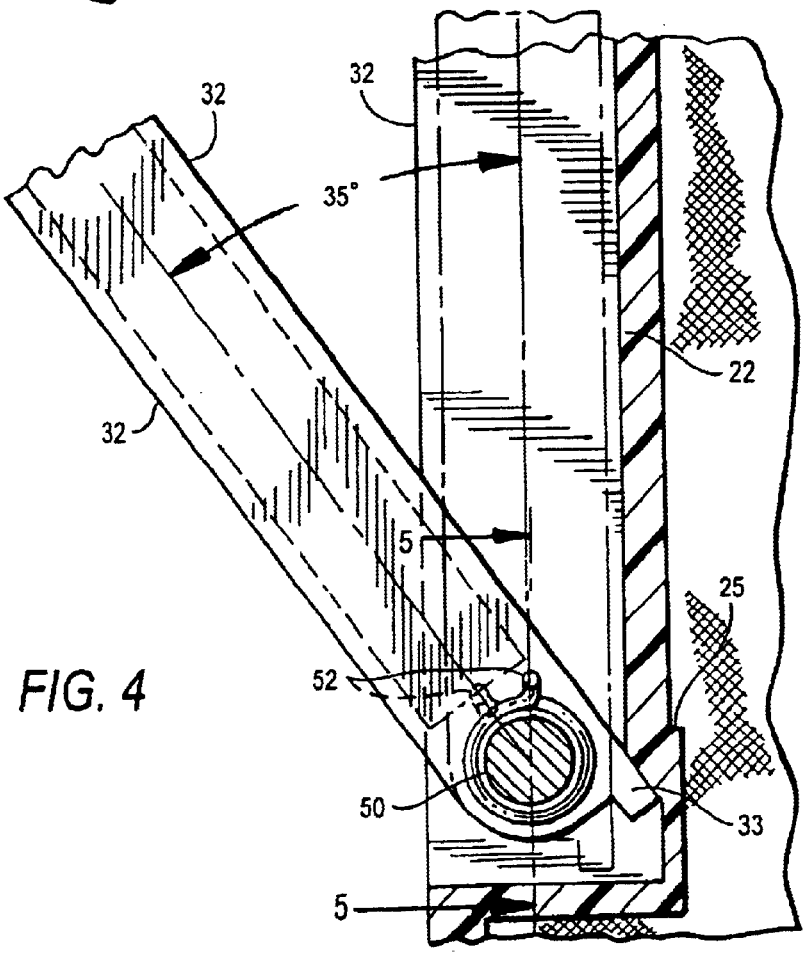
FIG. 4

FIG. 5
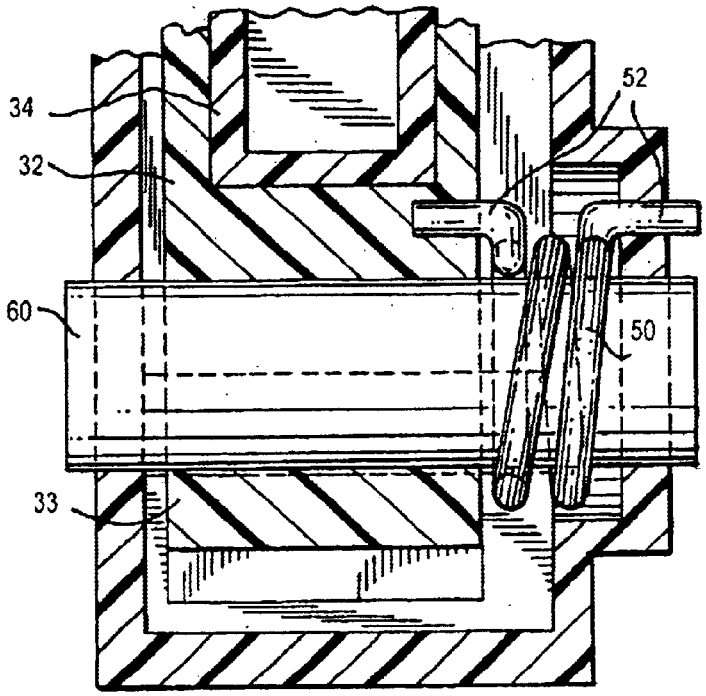
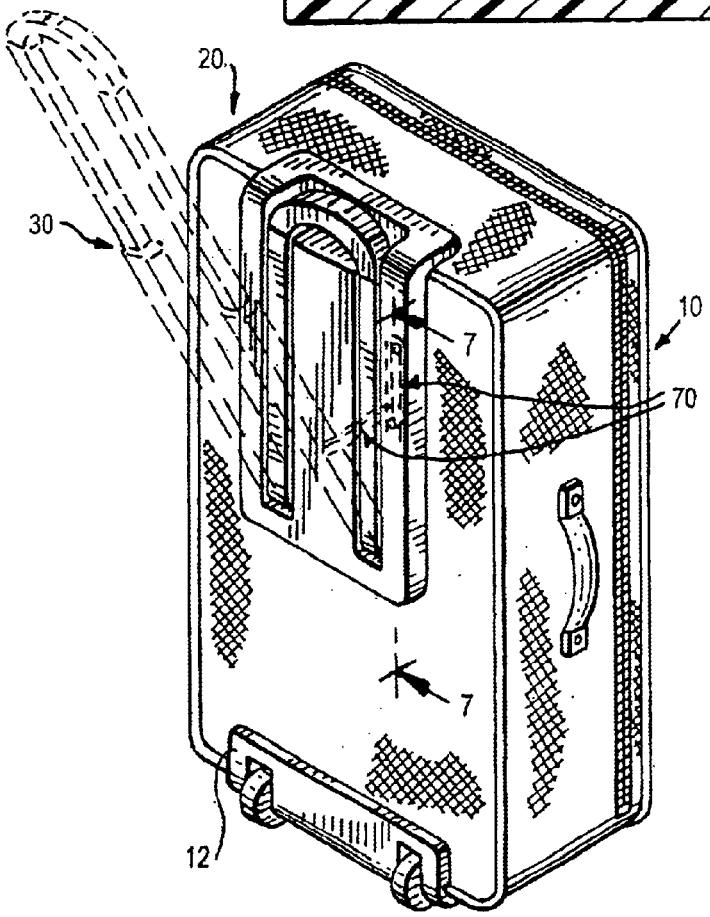
FIG. 6

HANDLE ASSEMBLY FOR WHEELED LUGGAGE

This application is a continuation-in-part of my application Ser. No. PCT/US01/47847, filed Nov. 2, 2001.

FIELD OF THE INVENTION

This invention relates to wheeled cases and luggage having an extendable handle that pivots from a stowed position parallel to the rear wall of the case to tilt the case for towing.

DESCRIPTION OF THE RELATED ART

As used herein, "towed luggage" refers to wheeled cases and luggage of various sizes and styles that are provided with a pivotally-mounted rigid handle that optionally extends and retracts, i.e., it telescopes from a position on, or adjacent to one of the walls, where the wheels or rollers are mounted at the base of, or proximate to the same wall that is adjacent to the handle.

The entire disclosures of my U.S. Pat. Nos. 5,868,406 and 6,129,365 are hereby incorporated herein by reference. Also incorporated herein by reference is the disclosure of my application PCT/US01/47847. U.S. Pat. No. 5,868,406 generally discloses a handle inclined at an angle to the rear wall of the case when the handle is extended with respect to the case and when it is retracted into the case. The handle in the retracted state is received in a housing mounted in the case for guiding and supporting the handle at an angle that is fixed with respect to the rear wall of the case. FIGS. 3, 4, 5 and 6 in U.S. Pat. No. 5,868,406 clearly show the construction of the inclined handle and the housing for supporting and guiding it with respect to the wheeled case.

It has been found that a fixed inclined handle is potentially subject to damage, i.e., bending or possibly even breaking if the case falls on the grip extended end of the handle. My U.S. Pat. No. 6,129,365 generally discloses several embodiments of a handle designed to resist such bending or breakage. These embodiments generally involve dividing the handle into two separate sections connected by means allowing rotation between the two sections, thus avoiding bending or breakage of the handle.

Despite their obvious advantages, problems and disadvantages are left unalleviated by the improvements disclosed in these two patents. First, since the guiding means for the handle is disposed at the same angle as the angle which the handle makes with the rear wall of the case, the length of the guiding means is limited by the angle which it makes with the rear wall of the case and the distance between the rear wall and the front wall of the case, if it is assumed that the guiding means is contained within the case. This may limit the length of the inclined handle which can be contained within the guiding means, and if such length is too short, use of a telescoping inclined handle becomes necessary. Furthermore, the construction employing a handle extending and retracting from a fixed guide necessitates the modifications of my U.S. Pat. No. 6,129,365, if the potential for bending or breakage is to be avoided or minimized.

It has been recognized in the art that the actual or apparent effort expended by the user of towed luggage can be minimized if the extended handle exerts only a slight downward force on the user's hand and arm during towing of the wheeled case. In U.S. Pat. No. 5,943,936, assigned to Samsonite Corp., a stowable handle is disclosed that can be withdrawn to an intermediate or fully extended position for moving a large case having four supporting wheels. The case itself is not rectilinear and the front and back wall are displaced from the vertical. The portion of the handle legs adjacent the handgrip are curved inwardly with a contour that overlies and conforms to the contour of the top of the luggage.

By permitting the handle to be withdrawn to at least two different lengths, the height of the handle grip above the towing surface can be varied. According to the disclosure of the Samsonite '936 patent, this allows the user to optimize the position based upon the user's height/arm length as well as the weight and load distribution in the wheeled luggage and any attached auxiliary luggage. However, the extendable handle can be moved in only one direction, i.e., parallel to the back wall of the luggage. Depending upon the load and its distribution, the optimum position for the handle grip is very likely to be displaced only a few degrees from a vertical plane passing through the axis of the wheels. Regardless of the height of the handle above the towing surface, this will be a very uncomfortable position for all users during towing because the luggage will be impacting the back of the user's heels, or very nearly so, during a normal pace.

A variety of other mechanisms and constructions have been disclosed for incorporating extended handles and handle assemblies into wheeled luggage. Representative of the prior art constructions is U.S. Pat. No. 5,693,319 disclosing a retractable handle assembly that is vertically extendable from a concealed position in a mounting assembly attached to the back wall of a wheeled case.

A retractable handle assembly is disclosed in U.S. Pat. No. 5,615,757 that is externally mounted on a sidewall of a four-wheeled case that is not tipped for towing. A four-wheeled case is disclosed in U.S. Pat. No. 5,377,795 that can be towed horizontally, or by tipping the case onto a pair of caster wheels, and that has an extendable handle that can be mounted on an exterior wall above the caster wheels, or in supporting tubes inside the case.

Externally mounted retractable handle assemblies are disclosed in U.S. Pat. Nos. 5,339,934 and 5,547,053 that are pivotally joined to a mounting plate for horizontally towing luggage without tipping it.

It will be readily appreciated that all of these embodiments share the characteristic of a breakage-resistant handle. In a situation where the handle is at an inclined angle and the case and the handle fall such that the outermost end of the handle contacts the ground first, the danger of breakage or bending of the handle will be minimized, despite the lack of any deliberate sectioning of the handle as described in my U.S. Pat. No. 6,129,365. This is so simply because the force of any such fall will be transmitted through the handle to the range-limiting means, thus allowing the handle to assume a position parallel to the rear wall of the case and avoid breakage or bending of the handle.

It is therefore an object of this invention to provide a handle assembly from which the handgrip of the towing handle, when extended, optimizes the user's comfort and facilitates towing, by minimizing the vertical force that must be applied to the handle grip to thereby minimize exertion and fatigue.

Another object of the invention is to eliminate any special modifications to the handle to prevent bending or breakage should the case fall on the extended handle.

Another object of the invention is to provide an extendable handle that can be withdrawn from a manually releasable locked storage position on the exterior of the case and adjusted angularly to a predetermined position in order to optimize the towing position for the user by minimizing the force required to tow the case.

Another object of the invention is to provide a handle assembly that is readily adaptable for installation on both hard-sided and soft-sided cases and luggage of various sizes and styles.

A further object of the invention is to provide a handle assembly that can be set at a predetermined angular position after being moved from the stowed position adjacent the rear wall of the case to the towing position.

It is also an object of the invention to provide a handle assembly that can be installed on either the exterior or interior rear wall of a case or luggage.

Another object of the invention to provide a handle that can be set at a fixed angle with respect to the rear wall of the case, and which will rotate in response to the force of an impact if the case falls on the extended handle, thereby avoiding bending or breaking.

SUMMARY OF THE INVENTION

The above objects and other benefits and advantages are achieved by the present invention which comprises a handle assembly for a wheeled case or other wheeled luggage that stores the retracted handle in a stowed position parallel to the rear wall of the case and provides for the pivotal displacement of the handle to at least one fixed position that is at a predetermined angle to the rear wall of the case.

A first embodiment of the invention comprises a pivoting handle assembly (20) for use with a wheeled luggage case (10), the assembly comprising:

- a handle (30) that includes at least one rigid leg (32) joined at one end to a transverse handgrip (36), the at least one leg being pivotally movable between a first stowed position(s) and a second, angularly displaced towing position (T),
- a mounting plate (22) for receiving and retaining the handle (30) in pivotally-mounted relation, the mounting plate adapted for mounting the handle for access from the exterior of the case;
- pivotal mounting means (50) joining a portion of the handle to the mounting plate; and
- at least one range-limiting means (60) operatively engaging the mounting plate (40) and the handle (30),
- whereby the angle defined by the at least one leg of the handle and the mounting plate is fixed when the handle is in the towing position.

The handle can comprise two legs in the form of tubes pivotally mounted on the mounting plate and a contoured grip joining the free ends of the legs. This U-shaped handle is preferably telescoping so that the handle can be extended for use and retracted for stowing. The U-shaped handle is held in its fixed angular position by range-limiting means that releasably lock into position. The handle is returned to a stowed position in the contoured mounting plate on the back of the case by manually releasing the range-limiting means.

In a second embodiment of the invention, the handgrip is T-shaped or L-shaped and can be rotatably mounted at the free end of a single leg, thereby allowing the user to manually rotate the handle to a desired or predetermined position during towing of the case. In any event, it will be understood that the mounting plate is appropriately contoured to receive the retracted handle leg or legs and handgrip.

It has been found in the course of various experiments and tests with prototype constructions embodying the invention, that a relatively narrow range of angular displacement, e.g., from the vertical, will allow a large majority of users to comfortably tow different sizes of wheeled luggage. This finding applies to a group of users whose height varied considerably from about five feet to well over six feet. This is a surprising finding, since it has long been assumed that the reasonably comfortable hand position for a tall user who was well above the mean or average male height of 5'-9", would be significantly different than that of a shorter user of a height well below the mean height.

Thus, what has been found is that for users within a broad range of heights, that when the hand is extended rearwardly in the towing position, the vertical distance between the hand and the floor are substantially the same. From this determination, it has further been found that there is a limited range of angular displacement which creates a greatly improved, if not optimum center of gravity position that maximizes comfort and minimizes effort and strain during towing. This finding applies to luggage that is packed; to luggage packed and supporting another piece on the top; or to luggage packed and carrying an accessory on a strap that shifts the weight to the vertical wall opposite the extendable handle.

In an especially preferred embodiment of the invention, the extended handle is angularly rotatable to a towing position that is displaced about 32° to 38° from the vertical. In a most preferred embodiment, the towing position is about 35° from the vertical.

When the handle is moved to the predetermined position of angular displacement with respect to its stowed position, the range-limiting means provides a sufficiently secure engagement to maintain the handle at this predetermined angle in resistance to those forces that are anticipated during normal towing of the case, including movement of the case across rough paving, over curbs and up and down staircases. However, should the case inadvertently be allowed to fall over on the extended tilted handle, the range-limiting means will be dislodged or disengaged by the force of impact and cause the handle to rotate back in the direction of the rear wall of the case, thereby avoiding any bending or other damage to the handle assembly or the range-limiting means.

BRIEF DESCRIPTION OF THE DRAWINGS

The invention will be apparent to those of ordinary skill in the art upon consideration of the following description of the preferred embodiments and the attached drawings in which like elements are referred to by the same number, and in which:

FIG. 3 is a detailed cross-sectional view illustrating the manual operation of the release mechanism of FIG. 2;

FIG. 4 is a cross-sectional view, partly in phantom, taken along lines 4—4 of FIG. 1 and illustrating the angle of the handle relative to the back wall in the towing position;

FIG. 5 is a cross-sectional view illustrating one embodiment of a release mechanism that will permit movement upon an impact force applied to the extended handle;

FIG. 6 is a top, rear and side perspective view of a wheeled case illustrating another embodiment of the invention;

DESCRIPTION OF THE PREFERRED EMBODIMENTS

Figure 1:
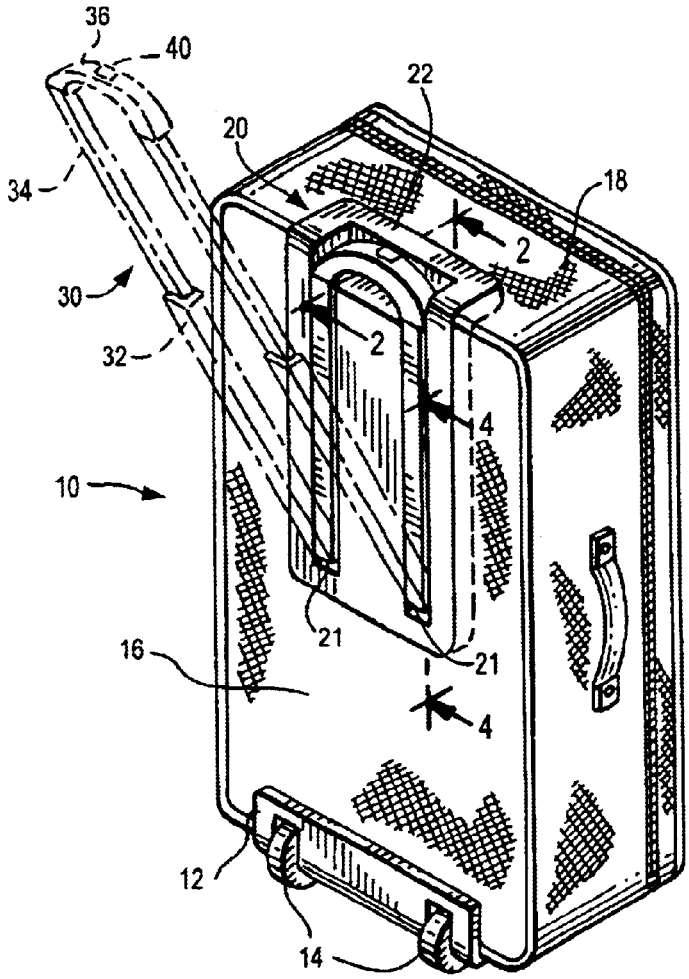
FIG. 1 is a top, rear and side perspective view of a wheeled case illustrating one embodiment of the invention, showing the extended handle in phantom.

With reference to FIG. 1, there is illustrated an article of wheeled luggage or case 10, fitted with a wheel assembly 12, comprising a pair of wheels 14 attached to the junction of the back 16 and a sidewall 18 of the case. The case 10 can be fabricated from rigid materials, including polymers, metal and/or composites, all of which are well known in the art; or from fabrics such as woven nylon attached to a supporting frame work. The case can be provided with a manual carrying handle 15, on one or more of the sidewalls. The wheels 14 can be replaced by one or more rollers (not shown). The construction of the case or luggage can be in any manner known to the prior art, or that may be subsequently developed.

With continuing reference to FIG. 1, pivoting handle assembly 20 of the invention is shown secured to the back 16 and upper side wall 18 opposite the wheel assembly 12. The pivoting handle assembly 20 can be constructed from metal, or, preferably, from a combination of molded polymeric and metal elements. The assembly 20 comprises a handle 30 and a mounting plate 40 for receiving and retaining the handle in a pivotally-mounted relation.

As shown in the illustrative example of FIG. 1, the handle is generally U-shaped and is comprised of a pair of optionally telescoping legs 32 joined at one end to a transverse handgrip 36. The handle is pivotally moveable between a first stowed position and a second, angularly displaced tilted position "T".

The generally U-shaped handle 30 is stowed in a corresponding recess 21 in mounting plate 40, which is adapted to receive the handle in secure engagement in the stowed position and to protect the handle 30 while the bag is in being carried by handle 15 or in the care of the airline of other transportation service provider. Thus, the configuration of the mounting plate 40 and its receiving recess serves to isolate the handle from impact from other pieces of luggage, luggage conveying systems, and the occasional rough handling experienced during transport.

Figure 1A:
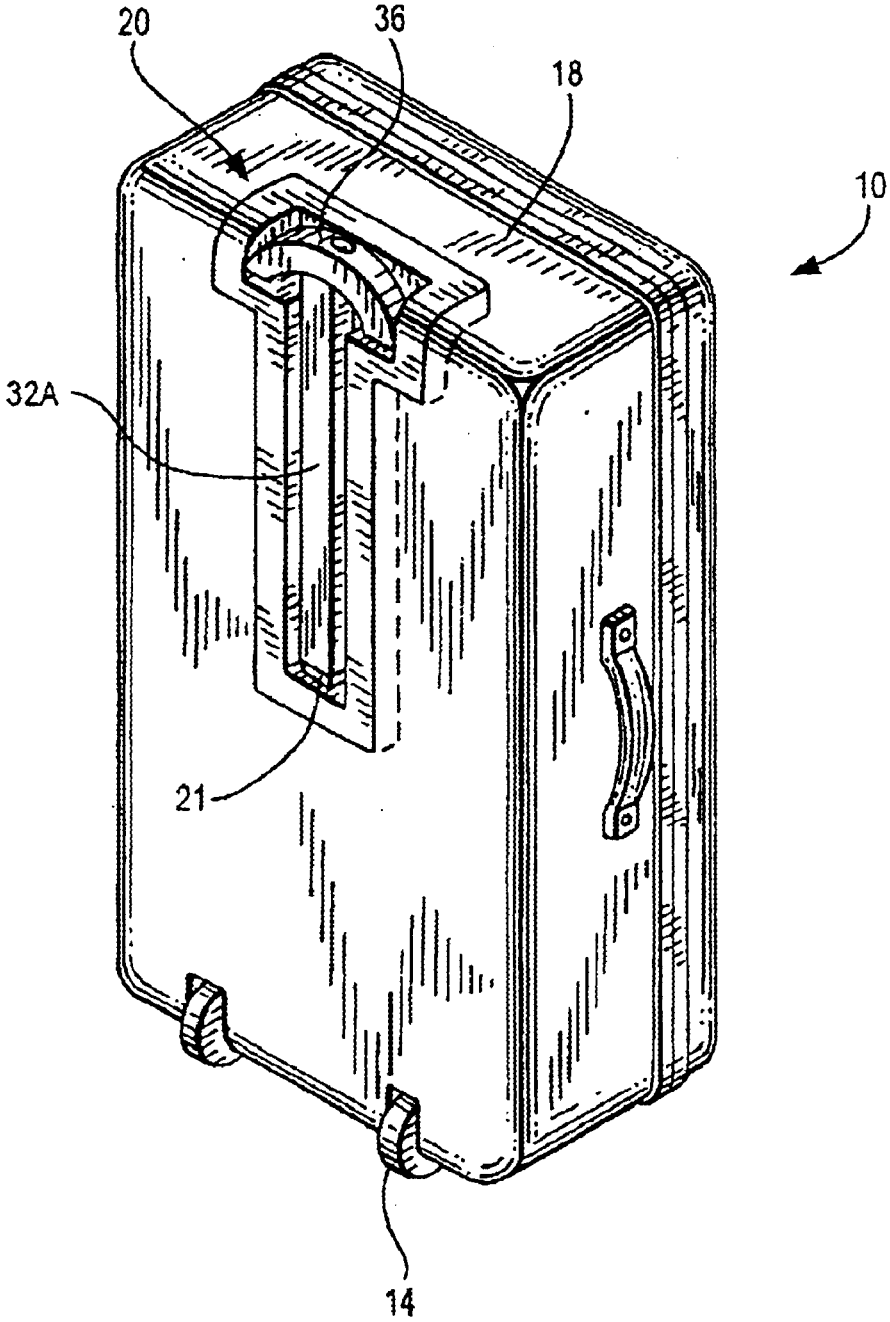
FIG. 1A is a view similar to FIG. 1 showing a case with an alternate style handle.

As will also be understood by one of ordinary skill in the art, the towing handle 30 can comprise a single leg with a handgrip 36 that defines a generally D-shaped or L-shaped or T-shaped configuration 32A, e.g., as shown in FIG 1A. In this construction, the mounting plate will have a corresponding T-shaped or L-shaped recess to similarly receive the single-legged handle in a pivoting relation. If desired, the handgrip can be rotationally mounted on the free end of the leg.

Depending upon the height of the case in the towed position, it may be desirable to include a telescoping leg member 34 that is received in the exterior leg member 32 in sliding relation. The construction of telescoping towing handles is well-known in the art and does not constitute a specific feature of this invention. Any of the constructions and release mechanisms known to the prior art, or subsequently developed, can be employed in the practice of the present invention.

If the case is unusually large in the longitudinal dimension i.e., from the wheel assembly 12 to opposing wall 18, a non-telescoping handle can be efficiently utilized.

Figure 2:
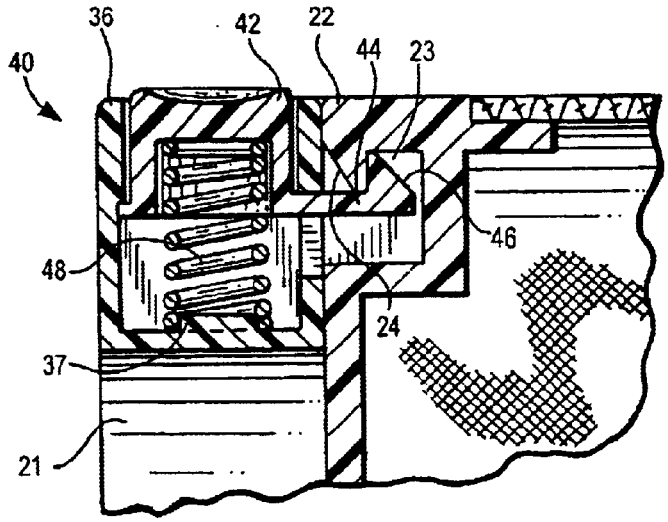
FIG. 2 is a detailed cross-sectional view taken along lines 2—2 of FIG. 1.

With continuing reference to FIG. 1 and in conjunction with FIGS. 2 and 3, it will be seen that the handgrip 36 is provided with a manually-actuated release member 42 to disengage a lock member which secures the handle in the stowed position. As best shown in FIGS. 2 and 3, a release button 43 is depressed against the biasing force of spring 48 to disengage hasp 46 from retaining element 23, which is advantageously integrally molded into a locking recess in the upper portion of mounting plate 22. The locking member 46 is joined to the release by arm 44, and upon the depression of release 42 the handgrip and legs can be withdrawn from recess 21 to at least one fixed towing position.

In the preferred embodiment of the invention, the handle forms an angle of about 35° to the vertical when the handle is extended and before the case has been tipped for towing. This relationship is clearly indicated in the illustrations of the embodiments depicted in FIGS. 4 and 10.

In another embodiment, (not shown), a second fixed angular towing position is provided to accommodate users whose stature or other particular physical requirements will render an alternative towing position more comfortable.

The handle assembly can be mounted entirely on the exterior surface of the back wall, or its exterior surface can be flush with that of the back wall. In the latter construction, the assembly will project into the interior cargo space of the case. The handle assembly is secured to interior frame members of the luggage case in accordance with methods and structures well known in the art. For example, threaded fasteners, rivets and adhesives can be employed. The rear and/or sides of mounting plate can be provided with grooves and recesses to receive frame members of the case (not shown).

In a preferred embodiment, the handle assembly 20 extends partially into the interior of the case and its outer surface is flush with, or alternatively, projects somewhat above the surface of the back wall 16 and side wall 18. For example as illustrated in FIGS. 1 and 6, the exterior surface of assembly 20 and wheel assembly 12 project the same distance above the surface of back wall 16 to provide a flat supporting surface when the case is positioned for access.

With reference to FIG. 4, there is illustrated one preferred embodiment for mounting the leg members in pivoting relation to the mounting plate. A pivot pin or axle 60 is received in a corresponding aperture in the lower portion of leg 32. Torsion coil spring 50 is mounted on pivot pin 60 with its terminal end member parallel to the axis of pin 60. One of opposing end members 52 engages a portion of leg 32 and the other end member 52 engages a portion of the adjacent mounting plate 22. When the handle 30 is in the stowed position, a torsional force is applied tending to push the handle to the angular towing position. As most clearly shown in FIG. 4, the lower portion of handle 32 is formed with a stop member 33 that contacts engagement surface 25 formed in a proximate portion of mounting plate 22. The configuration of stop 33 and engagement surface 25 is adapted to allow the handle 30 to move to a position of about 35° from the vertical or stowed position. The torsional force of spring 50 is sufficient to maintain the handle in the 35° towing position, while also allowing the user to press the handle into the stowed position against its force.

In a preferred embodiment, torsion springs 50 are mounted on the pivot pins 60 at the base of both lets of a U-shaped handle. Alternatively, a single spring having the required characteristics can be employed. Where a single leg is used in the construction of the T-shaped or L-shaped handle, a single spring can be used or, alternatively a pair of torsion springs mounted on either side of the single leg in appropriately configured recesses.

Referring again to FIG. 3, it will be understood that when the handle is pivotally rotated towards the case, the inclined surface of lock hasp 44 will slidingly contact the correspondingly inclined surface 24 allowing the lock member to enter recess 23 and mounting plate 22. When completely inserted, the hasp will engage the depending member to secure the handle in position in the recess against the torsional force applied to one or both legs by the torsional spring 50.

As will be apparent to one of ordinary skill in the art, various other locking means and lock configurations can be employed for retaining the handle in the stowed position. For example, the spring-loaded release button 42 and hasp 44 can be located on the mounting plate so that the hasp will engage an appropriately configured opening on the side or bottom wall of the handgrip 36 as it is pivotally rotated into the stowed position.

A lock mechanism can also be incorporated into the mounting plate 40 to releasably engage one or both leg members 32 when the handle 30 is moved to the vertical position, and, optionally, before the leg(s) 34 are retracted to lower handgrip 36. Any of a variety of other lock and release mechanisms that are well known in the art can be employed.

In a further preferred embodiment, a manually activated positive release means is operatively connected to the range-limiting means to facilitate the movement of the handle from the towing position to the stowed position. The positive release means can be activated by movement of a spring-biased push button release bar, release lever, or the like. The push button or other device that is used to activate the release mechanism can be positioned on the handgrip 36 or on the mounting plate 22. The release will preferably take the form of an elongated inextensible member or assembly that will transmit to manual force of the user's finger(s) or thumb to the range-limiting means.

Thus, the release mechanism can comprise a release cable or wire rope, one or more linked rods or bars, bellcranks carried in a tube and/or over pulleys, a series of levers and pivot pins, or a combination of these mechanical elements.

In the embodiment utilizing a torsion spring, as is illustrated in FIGS. 4 and 5, one end 52 of the spring 50 can be supported by a moveable contact member that is joined to one end of a release cable, the opposite end of the cable being secured to a release push button located on the handgrip 36. When it is desired to move the handle 30 from the pivotally extended towing position to the stowed position, the release button is depressed, causing the release cable to move the contact plate and thereby reducing the effective force of the spring to facilitate manual movement of the pivoting handle.

In the embodiment of the stop-locking hinge described above, and particularly with reference to FIG. 9, a release cable, bar or lever is operatively connected to hinge plate 72. When depressed, the release button extends the release mechanism to lift the hinge plate from the extended locked position. This reduces the force required to return the handle to the stowed position.

As will be apparent to those of ordinary skill in the art, numerous other manually operable release mechanisms can be employed in the construction of the assembly of the invention. A variety of such mechanisms have been disclosed and commercialized by the art in positive release and locking mechanisms for extending and retracting telescoping handles. The push button or bar is commonly located in the handgrip and when depressed, causes movement of a pin or ball catch or other equivalent mechanism, that permits relative movement of the handle sections.

Figure 7:
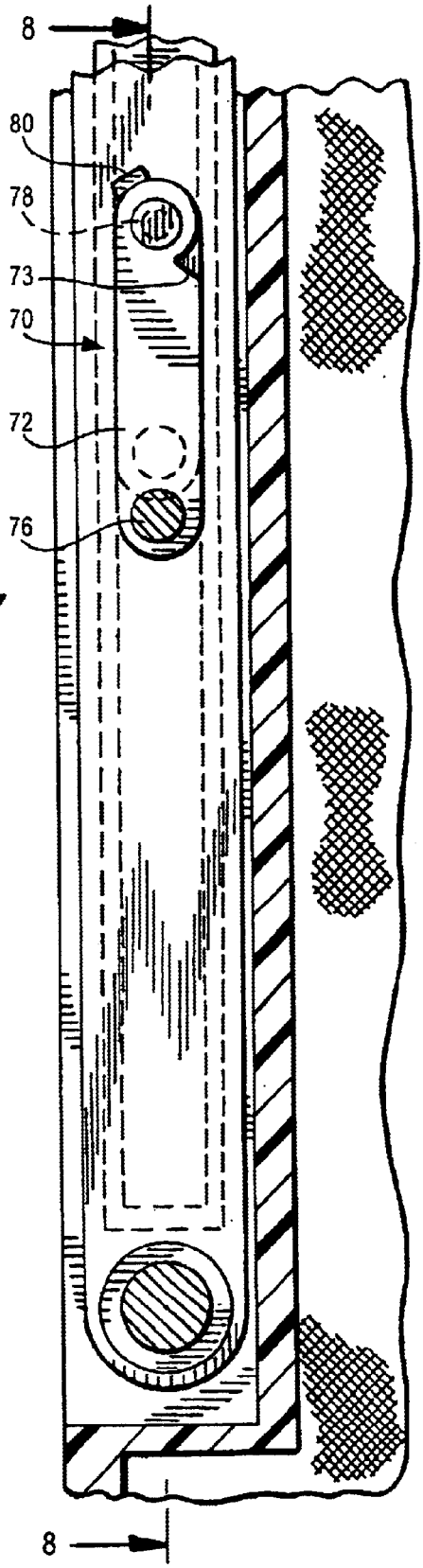
FIG. 7 is a side elevation detail view partly in section, of the retaining mechanism, shown partly in phantom in FIG. 6, taken along line 7—7 of FIG. 6.
Figure 8:
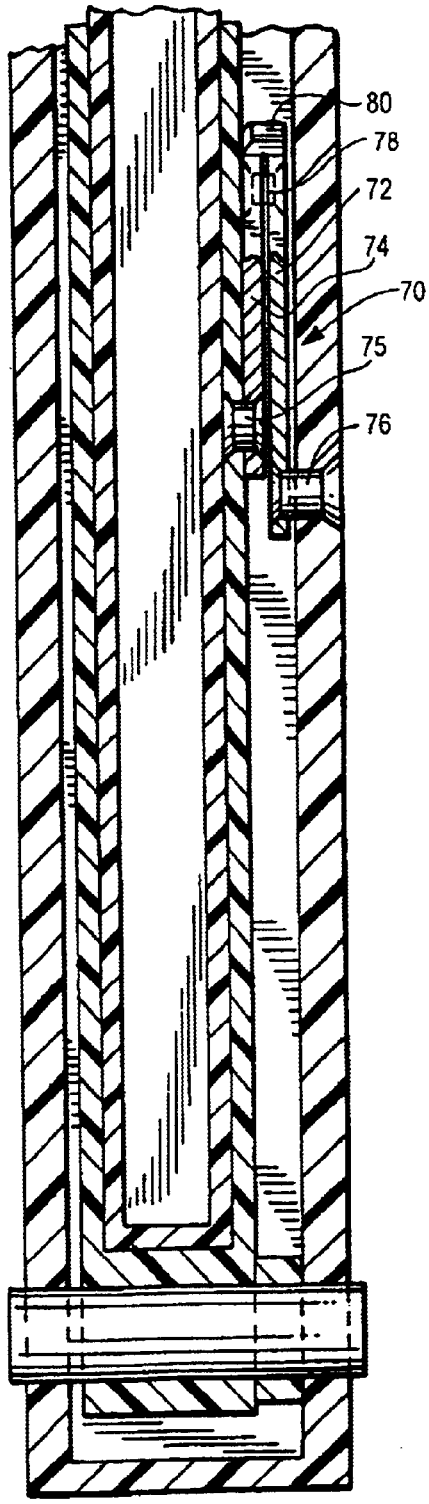
FIG. 8 is a cross-sectional view taken along line 8—8 of FIG. 7.
Figures 9, 10:
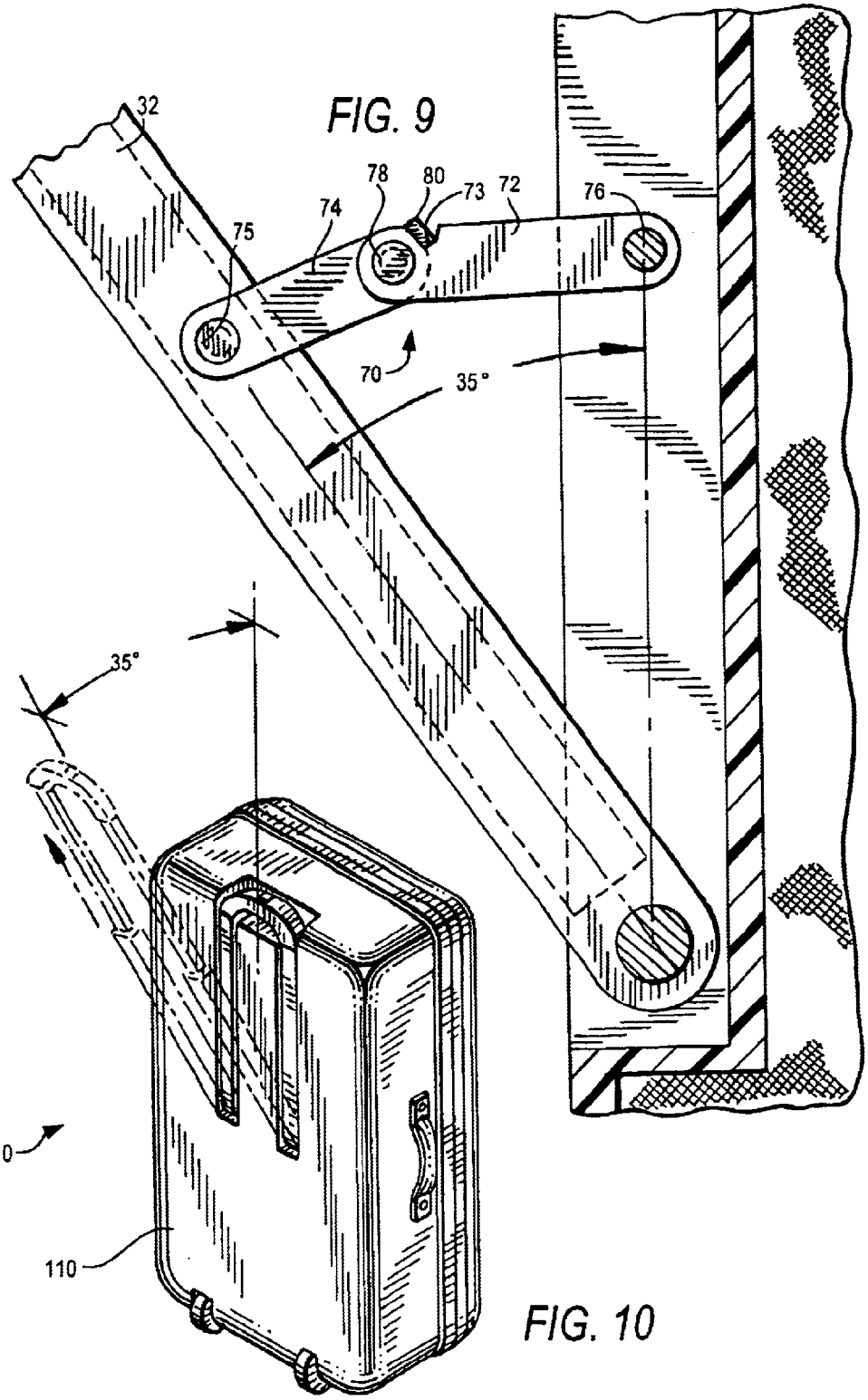
FIG. 9 is a view similar to FIG. 7 showing the retaining mechanism with the handle in the towing position.
FIG. 10 is a view of a molded luggage case embodying the invention.

With reference to FIGS. 6–10, an alternative means for limiting the range of movement of the pivoting handle 30 is illustrated. As shown in phantom in FIG. 6, when the handle is drawn from the stowed position in the mounting plate 20, range-limiting locking hinge 70 retains the handle at an angle that is preferably about 35° from the vertical. This angular relationship is also shown in FIGS. 9 and 10.

The arrangement and construction of the locking hinge will be described in more detail with reference to FIGS. 7–9. Referring to FIG. 7, locking hinge 70 is attached at one end to leg 32 and at its opposite end to mounting plate 22 by appropriate fasteners 75, 76, which can be rivets. The pivot pin 78 secures arms 72 and 74 together.

Lock bar 80 extends from arm 74 and in the fully extended position engages groove 73 in arm 72. As can be seen from FIG. 9, the arms 72 and 74 form an obtuse angle in the extended, locked position, retaining handle 32 at an angle this is preferably about 35° from the vertical.

In the event that the case were inadvertently to fall backwards on the extended handle 30, the force on the handle would forcibly disengage the lock bar 80 from groove 73. The initial locking engagement is sufficient to prevent disengagement during normal towing. The locking engagement can include an assembly with resilient members that are reversibly deformed upon impact, and the use of spring-biased ball catches and/or rotating spring-loaded friction plates or clutches.

From the above description, it will be apparent that the resistance to damage from impact of the handle assembly of the invention is a major advantage.

As will be apparent to one of ordinary skill in the mechanical arts, other constructions can be employed to move the handle to the desired fixed position and releasably retain it there until the user or an unexpected impact of predetermined minimum force cause its movement towards the back wall of the case. For example, the range-limiting means can comprise a spring-loaded pneumatic cylinder attached at one end to one or both of the handle legs and, at the other end, to the mounting plate. When the handle lock member is released, the force of the spring moves an internal cylinder and rod against the pneumatic pressure in the cylinder to extend the handle to the predetermined preferred angular position of 35°. The piston has an internal pressure-sensitive release valve that opens when a predetermined force is imposed, as when the user wishes to return the handle to the stowed position, or when the case is inadvertently allowed to fall on the extended handle. Various other slide arms and levers with spring-loaded or biased ball and detent catches and/or friction plates can be employed as the range-limiting means.

Furthermore, the pivot pin or pins 60 through handle legs can be displaced from the end so that the portion of the legs 32 below the pivot axis can receive a force to move the handle angularly from the stowed position and maintain it in the towing position. One or more coil springs in compression in the stowed position are secured between the mounting plate and the free end of the leg below the pivot axis to rotate the handgrip 36 away from the backwall 16.

Another embodiment of the invention is illustrated in FIG. 10, where the lower cargo-carrying portion 110 of the case 10 is molded or otherwise formed as a unitary element. In this embodiment the range-limiting means is not shown with the phantom handle in the interest of simplifying the depiction. In the context of the above description of the invention, the mounting plate 22 subsumes the entire lower portion 110 of the molded case 10. Thus, as used in the appended claims, it is to be understood that the definition of the mounting plate is intended to encompass the lower portion of rigid molded or formed luggage and cases.

Furthermore, it should be understood that the first embodiment of the invention showing a mounting plate for receiving and supporting the handle extending only partially down the back wall of the case is by no means a requirement, and that the mounting plate can extend further down the case, i.e., for the entire length of the wall adjacent to which it is positioned, thereby optionally eliminating the need for a telescoping handle, or handles of greater length. The use of a longer mounting plate can include tube(s) or channel(s) from which the handle is withdrawn from the stowed position to the towing position, at which the handle's vertical movement is stopped and is rotated arcuately to the predetermined inclined position.

Furthermore, it should be noted that inclined handles such as those disclosed above, and in my previously mentioned United States patents, have the general advantage of keeping the case further from the body of the user, given the position of the hand of the user in towing the case, than would be the situation if the handle extended parallel to the rear wall of the case. This will have the beneficial result of preventing the case from colliding with the user's heel when the case is towed behind the user, which can frequently happen with a conventional handle parallel to the rear wall of the case. Thus, it will be apparent that the inclined handle cases, of the present invention will require a user to exert less force on the handle to keep the case at a particular angle of tilt, when compared to a case in which the extended handle is parallel to the rear wall.

The preferred embodiments described illustrate the inclined handle assembly mounted on the rear wall of the case, thereby allowing movement in the two co-linear directions parallel to the side walls 17 of the case. It should be understood that an inclined handle can also be mounted on either side wall 17 of the case, thereby allowing the case to be wheeled in either of the two co-linear directions parallel to the rear wall 16 of the case, provided that the case is fitted with appropriate and properly placed wheels. This latter embodiment would include the use of at least one caster wheel that is mounted to swivel in response to the directional force applied to move the case.

It should be clear to those of ordinary skill in the art that further modifications and embodiments of the present invention can be made and that the scope of the invention is to be determined by the following claims.

I claim:

1. A pivoting handle assembly (20) for use with a wheeled luggage case (10), the assembly comprising:

a handle (30) including at least one rigid leg (32) joined at one end to a transverse handgrip (36), the at least one leg being pivotally movable between a first stowed position and a second angularly displaced towing position (T), a mounting plate (22) for receiving and retaining the handle (30) in pivotally-mounted relation, the mounting plate adapted for mounting the handle on an exterior surface of the case;

at least one range-limiting means (60) operatively joined to the mounting plate (22) and the handle (30), whereby the angle defined by the at least one leg of the handle and the mounting plate is determined by the range-limiting means when the handle is in the towing position, wherein the range-limiting means is a folding stop hinge.

2. The assembly of claim 1, wherein the mounting plate has an outer surface that is contoured to provide a recess (21) to receive the handle in the stowed position.

3. The assembly of claim 2, wherein the handle comprises two legs and the mounting plate recess is generally U-shaped.

4. The assembly of claim 2, wherein the handle comprises one leg and the recess is generally T-shaped.

5. The pivoting handle assembly of claim 2, wherein the mounting plate comprises at least a portion of a rear wall of the wheeled luggage case.

6. The pivoting handle assembly of claim 5, where the mounting plate further comprises at least a portion of one or more side walls of the case.

7. The pivoting handle assembly of claim 5, wherein the mounting plate is selected from the group consisting of formed metal and molded polymeric materials.

8. The pivoting handle assembly of claim 5, wherein the handle comprises two legs and the recess is U-shaped and open to permit access to the top of the handgrip.

9. The pivoting handle assembly of claim 5, wherein the handle comprises two legs, the recess is generally U-shaped and the surface of the handgrip opposite the legs is spaced from the sidewall of the recess.

10. The assembly of claim 1, wherein the range-limiting member in manually operable.

11. The assembly of claim 1 which further comprises a releasable handle retaining assembly to retain the handle in the stowed position proximate the mounting plate.

12. The assembly of claim 11, wherein the returning assembly is locking and includes a manually operable release.

13. The assembly of claim 12, wherein the lock release member is positioned in the handgrip.

14. The assembly of claim 12, wherein the lock release is positioned in the mounting plate.

15. The assembly of claim 14 in which the lock release is a spring-biased push button or bar.

16. The assembly of claim 1, wherein the angle defined by the handle in the towing position and the mounting plate is about 35°.

17. A method of manually towing a wheeled luggage case by a handle attached to the exterior of a back wall of the case above a plurality of wheels or rollers, mounted on a lower portion of the case the method comprising:

a. providing a pivoting handle assembly;

b. mounting the pivoting handle assembly on the back wall of the wheeled case;

c. moving the handle by extending a folding stop hinge that forms part of the pivoting handle assembly from the stowed position to a fixed and secured position that forms an angle of 35° to the vertical;

d. manually gripping the handgrip and tilting the case; and e. towing the case in the tilted position.

18. The method of claim 17 in which the handle is pivotally attached to a mounting plate below the folding stop hinge.

19. The method of claim 17 in which the pivoting handle assembly comprises:

a handle (30) including at lease one rigid leg (32) joined at one end to a transverse handgrip (36), the at least one leg being pivotally movable between a first stowed position and a second angularly displaced towing position (T), a mounting plate (22) for receiving and retaining the handle (30) in pivotally-mounted relation, the mounting plate adapted for mounting the handle on an exterior surface of the case;

pivotal mounting means (50) joining a portion of the handle to the mounting plate;

the folding stop hinge defining a range-limiting means (60) operatively joined to the mounting plate (40) and the handle (30), whereby the angle defined by the at least one leg of the handle and the mounting plate is determined by the range-limiting means when the handle is in the towing position.

20. A pivoting handle assembly (20) for use with a wheeled luggage case (10), the assembly comprising:

a handle (30) including at least one rigid leg (32) joined at one end to a transverse handgrip (36), the at least one leg being pivotally movable between a first stowed position and a second angularly displaced towing position (T), a mounting plate (22) for receiving and retaining the handle (30) in pivotally-mounted relation, the mounting plate adapted for mounting the handle on an exterior surface of the case;

at least one range-limiting means (60) operatively joined to the mourning plate (22) and the handle (30), whereby the angle defined by the at least one leg of the handle and the mounting plate is determined by the range-limiting means when the handle is in the towing position, wherein the range-limiting means includes a coil spring.

21. The assembly of claim 20, wherein the coil spring is selected from the group consisting of torsion springs and compression springs.

* * * * *